US006536151B1

(12) United States Patent
Ketterer

(10) Patent No.: US 6,536,151 B1
(45) Date of Patent: Mar. 25, 2003

(54) SIDEARM MOUNTING AND LOCKING APPARATUS

(76) Inventor: Mark A. Ketterer, 5191 Taft, Algonac, MI (US) 48001

( * ) Notice: Subject to any disclaimer, the term of this patent is extended or adjusted under 35 U.S.C. 154(b) by 0 days.

(21) Appl. No.: 10/052,275

(22) Filed: Jan. 18, 2002

(51) Int. Cl.[7] ..... F41A 17/00
(52) U.S. Cl. ..... 42/70.11
(58) Field of Search ..... 42/70.11, 70.01; 211/64

(56) References Cited

U.S. PATENT DOCUMENTS

| | | | | | |
|---|---|---|---|---|---|
| 3,774,333 | A | * | 11/1973 | Reynolds | 42/1 |
| 4,328,687 | A | | 5/1982 | Ritchie | 70/34 |
| 4,398,366 | A | | 8/1983 | Wernicki | 42/14 |
| D341,072 | S | | 11/1993 | Bryant | D8/336 |
| 5,359,866 | A | * | 11/1994 | Boddy | 70/18 |
| 5,400,538 | A | * | 3/1995 | Shannon | 42/70.07 |
| 5,548,915 | A | | 8/1996 | Szarmach et al. | 42/70.11 |
| 5,664,358 | A | | 9/1997 | Haber et al. | 42/70.11 |
| 5,829,179 | A | * | 11/1998 | Carter et al. | 42/70.07 |
| 6,272,784 | B1 | * | 8/2001 | Ringers | 42/70.07 |
| 6,385,890 | B1 | * | 5/2002 | Amadini | 42/70.11 |
| 6,415,540 | B1 | * | 7/2002 | Ringers | 42/70.07 |

* cited by examiner

*Primary Examiner*—Peter M. Poon
*Assistant Examiner*—Denise J Buckley
(74) *Attorney, Agent, or Firm*—Gene Scott-Patent Law & Venture Group

(57) ABSTRACT

A sidearm mounting and locking apparatus comprises a base-plate adapted for surface mounting, the plate providing spaced apart guide-plates extending from the base-plate in side-by-side juxtaposition for cradling a sidearm therebetween. The guide-plates provide aligned pin apertures and a trigger blocking-pin adapted for engaging the pin apertures and positioned for disabling a trigger of the sidearm. A barrel supporting bracket assembly engages the base plate and is positioned for receiving a barrel of the sidearm in rest thereon. The barrel supporting bracket assembly includes a barrel-pin integral thereto and positioned within the sidearm barrel. The blocking pin is positioned for preventing withdrawal of the sidearm from the barrel-pin.

6 Claims, 2 Drawing Sheets

SIDEARM MOUNTING AND LOCKING APPARATUS

BACKGROUND OF THE INVENTION

1. Field of the Invention

This invention relates generally to gun storage devices and more particularly to a wall mounted rack for locking sidearms.

2. Description of Related Art

The following art defines the present state of this field:

Bryant, U.S. Pat. No. 341,072 describes a pistol lock design.

Ritchie, U.S. Pat. No. 4,328,687 describes a locking device for securing a firearm to a wall, having a first part securable to the wall and a second part insertable through the trigger guard of the firearm to be engaged with the first part, the second part being so shaped as to then retain the firearm on the wall. The second part has a shank portion which enters into an opening in the first part and a lock is provided operable to hold the shank when so entered. The first part is securable to the wall by screws passing through screw holes in the first part, which screw holes are selectively exposable by rotating a cover plate on the first part to align an opening in the cover plate with the screw holes. When the second part is locked to the first part the shank passes through the cover opening into the second part to lock the cover against rotation so that it cannot be rotated to a position giving access to the screw holes.

Wernicki, U.S. Pat. No. 4,398,366 describes a gun lock consisting of three parts which engage each other to provide a shaft extending through the gun barrel and the bullet chamber, the shaft being held in position by means of a combination lock. A dummy round occupies the bullet chamber and has a hollow cylindrical front portion with a groove for engaging the locking balls which are disposed on the inner end of an intermediate rod which extends through the bore of the gun barrel. The intermediate rod has a slideably moveable central actuator with a cam end portion for forcing the locking balls radially outward to engage the groove of the dummy round, and semi-circular recesses into which the locking balls can fall when the actuator is pushed in to permit insertion or removal of the intermediate rod. The combination lock secures the actuator to prevent it from being moved inward to release the intermediate member from the dummy round.

Szarmach et al., U.S. Pat. No. 5,548,915 describes a universal firearm disabling and alarm signalling system providing a construction, which is easily mounted to any firearm to prevent its unwanted use while also incorporating an automatic alarm signal, which is immediately activated whenever the protected firearm is accessed by unauthorized persons. By employing the present invention, any movement of the firearm, or attempt to remove the disabling and alarm signalling system of the present invention from the firearm, causes an alarm signal to be continuously generated, preventing any unauthorized or unwanted use of the firearm. In the preferred embodiment, the universal, combined firearm disabling and alarm system of the present invention incorporates lock means cooperatively associated with the alarm signal generator which is quickly and easily mounted to any desired firearm for preventing unwanted use of the firearm and remains in secure locked interengagement therewith until disengaged by the user.

Haber et al., U.S. Pat. No. 5,664,358 describes a barrel lock to be removably inserted and reliably locked within the barrel of a hand gun to prevent the accidental and unauthorized firing of the hand gun without requiring any manufacturing changes to the gun. The barrel lock includes an expandable chamber lock that is located at the distal end of a barrel lock tube. The barrel lock tube is adapted to slide inwardly through the gun barrel to locate the chamber lock to be received in and retained at the existing bullet chamber of the gun barrel, whereby the hand gun is disabled. A combination lock cooperates with the proximal end of the barrel lock tube to prevent the barrel lock tube from being withdrawn from the gun barrel and the chamber lock from being removed from the bullet chamber until a particular predetermined combination has first been successfully dialed in.

The prior art teaches gun locks and mounting devices but does not teach a wall mounted gun rack and combination locking device as described and claimed herein. The present invention fulfills these needs and provides further related advantages as described in the following summary.

SUMMARY OF THE INVENTION

The present invention teaches certain benefits in construction and use which give rise to the objectives described below.

A sidearm mounting and locking apparatus comprises a base-plate adapted for surface mounting, the plate providing spaced apart guide-plates extending from the base-plate in side-by-side juxtaposition for cradling a sidearm therebetween. The guide-plates provide aligned pin apertures and a trigger blocking-pin adapted for engaging the pin apertures and positioned for disabling a trigger of the sidearm. A barrel supporting bracket assembly engages the base plate and is positioned for receiving a barrel of the sidearm in rest thereon. The barrel supporting bracket assembly includes a barrel-pin integral thereto and positioned within the sidearm barrel. The blocking pin is positioned for preventing withdrawal of the sidearm from the barrel-pin. A means for locking the blocking-pin is positioned in the guide plates.

A primary objective of the present invention is to provide an apparatus and method of use of such apparatus that provides advantages not taught by the prior art.

Another objective is to provide such an invention capable of supporting a firearm and locking the firearm against unauthorized use.

A further objective is to provide such an invention capable of use with a range of firearm sizes.

A still further objective is to provide such an invention capable of being mounted onto a wall or other flat surface.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
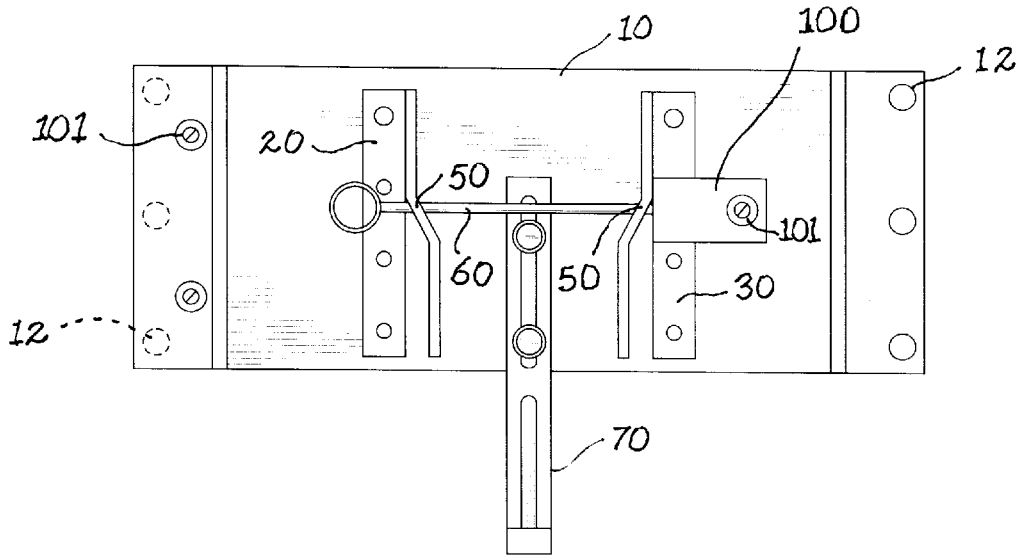
FIG. 1 is a front elevational view of a first preferred embodiment of the invention.

The present invention is a sidearm mounting and locking apparatus made of a structural material such as steel or high strength plastic composites. It comprises in combination: a base-plate 10 adapted by its shape for surface mounting onto a wall, for instance, using a base plate mounting means 12 such as the screw holes shown. Flat head screws would be used as these holes are countersunk. The base-plate 10 provides a pair of spaced apart guide-plates 20, 30 extending from the base-plate 10 in side-by-side juxtaposition so as to cradle a sidearm 40 therebetween. This is clearly shown in FIG. 2. The guide-plates 20, 30 provide aligned pin apertures 50 which are clearance holes. A trigger blocking-pin 60 is adapted, by its diameter and length, for engaging the pin apertures 50 and when installed is positioned for disabling a trigger (not shown) of the sidearm 40, i.e., the pin is positioned so that the trigger cannot be actuated. A barrel supporting bracket assembly is shown as element 70 in FIG. 1, and as element 80 in FIG. 3. In both embodiments the bracket assembly 70 or 80 engages the base plate 10 and is thus positioned for receiving a barrel 42 of the sidearm 40 in rest thereon. The barrel supporting bracket assembly 70 or 80 includes a barrel-pin 90-which is integral thereto and is positioned within the sidearm barrel 42 so that the sidearm cannot be removed without first extracting the blocking-pin 60. In other words, the blocking pin 60 is positioned for preventing withdrawal of the sidearm 40 from the barrel-pin 90. A means for locking 100 of the blocking-pin 60, as positioned in the guide plates 20, 30, is used to assure that the sidearm 40 cannot be removed without authorization. The locking means 100 can be any appropriate lock as is well known in the art. In FIGS. 1 and 3 a key lock is shown as element 101.

Figure 2:
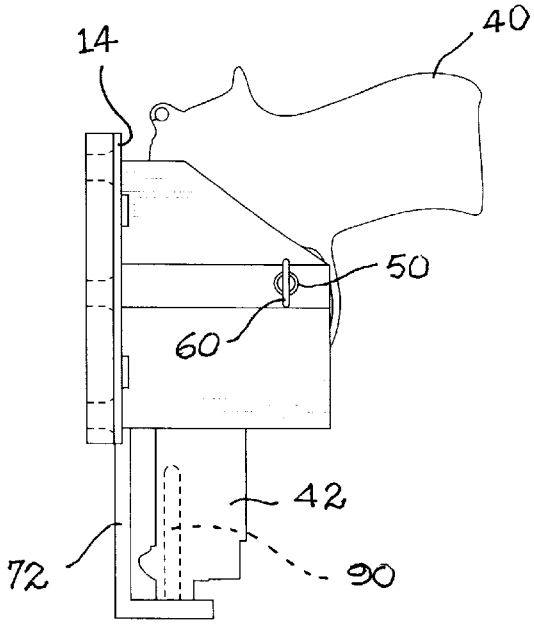
FIG. 2 is a side elevational view thereof.
Figure 3:
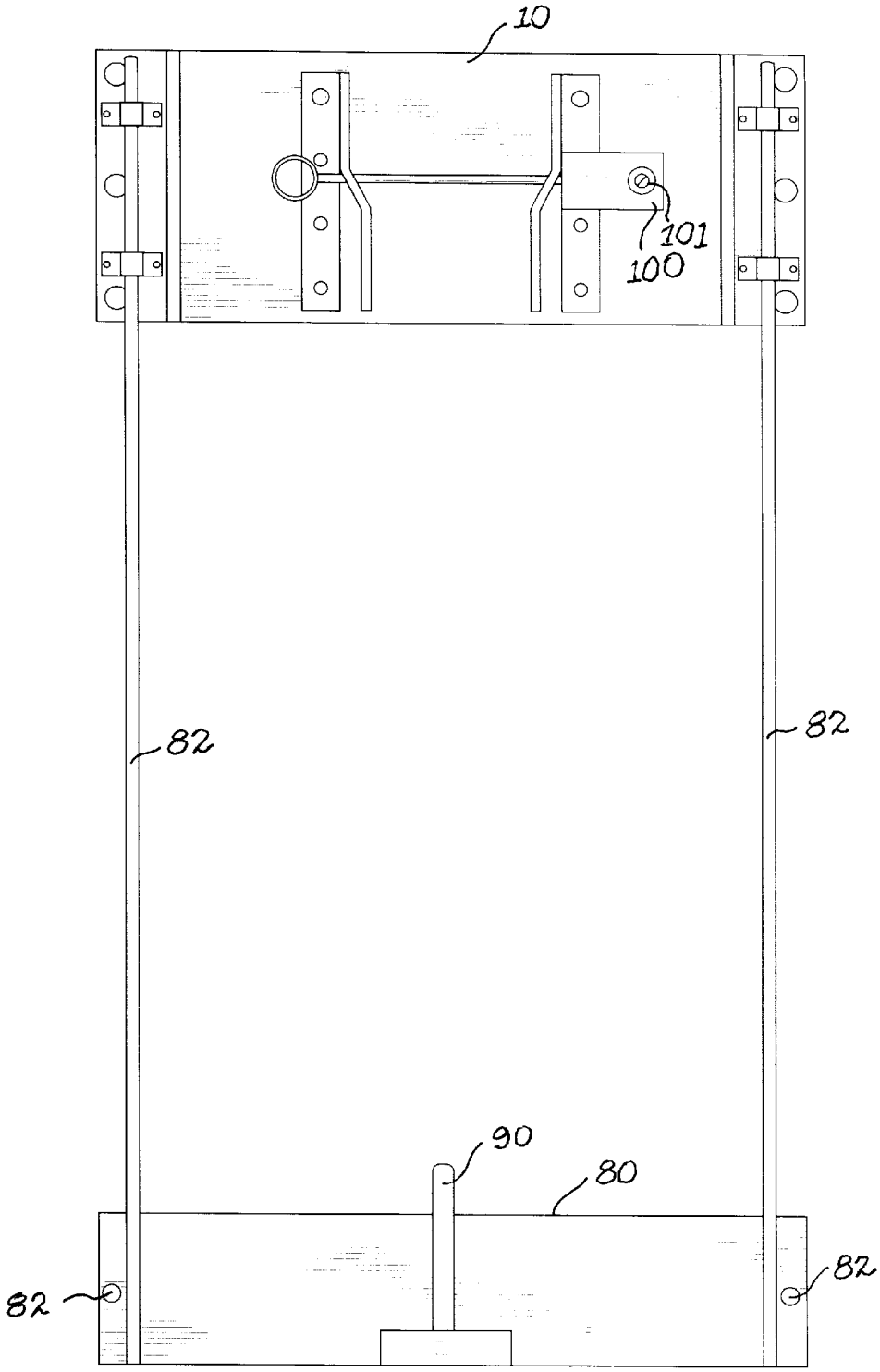
FIG. 3 is a front elevational view of a second embodiment of the invention.

In a first embodiment, the barrel supporting bracket assembly 70 preferably includes an L-shaped bracket 72 as best seen in FIG. 2. In a second embodiment, shown in FIG. 3, the barrel supporting bracket assembly 80 is engaged with the base plate 10 by two spaced-apart rods 82 which are slide-mounted for vertical adjustment of the bracket assembly 80 relative to the base-plate 410. In both embodiments we find a means for vertical adjustment of the barrel supporting bracket assembly 70 and 80 for accommodating a range of sidearm sizes, i.e., barrel lengths. In the embodiment of FIG. 3, the barrel supporting bracket assembly 80 is separately mounted to a wall or other flat surface using holes 82.

Preferably, the apparatus includes a means for inhibiting access 14 to the base plate mounting means 12. This may include, among other solutions, a flat cover plate, shown in FIG. 2 with key locking as previously described.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A sidearm mounting and locking apparatus comprising in combination: a base-plate adapted for surface mounting, the plate providing spaced apart guide-plates extending from the base-plate in side-by-side juxtaposition cradling a sidearm therebetween, the guide-plates providing aligned pin apertures; a trigger blocking-pin adapted for engaging the pin apertures and positioned for disabling a trigger of the sidearm; a barrel supporting bracket assembly engaging the base plate and positioned for receiving a barrel of the sidearm in rest thereon; the barrel supporting bracket assembly including a barrel-pin integral thereto and positioned within the sidearm barrel; the blocking pin positioned for preventing withdrawal of the sidearm from the barrel-pin; and a means for locking the blocking-pin as positioned in the guide plates.

2. The apparatus of claim 1 wherein the barrel supporting bracket assembly includes an L-shaped bracket.

3. The apparatus of claim 1 wherein the barrel supporting bracket assembly is engaged with the base plate by two spaced-apart rods.

4. The apparatus of claim 3 wherein the rods are slide-mounted for vertical adjustment of the bracket assembly relative to the base-plate.

5. The apparatus of claim 1 further comprising a means for vertical adjustment of the barrel supporting bracket assembly for accommodating a range of sidearm sizes.

6. The apparatus of claim 4 further comprising a means for inhibiting access to a base plate mounting means.

* * * * *